US007318367B2

(12) United States Patent
Billings

(10) Patent No.: US 7,318,367 B2
(45) Date of Patent: Jan. 15, 2008

(54) CARPET INSTALLATION TOOL

(76) Inventor: Gary Billings, 4523 Pine Ave., Hammond, IN (US) 46327

( * ) Notice: Subject to any disclaimer, the term of this patent is extended or adjusted under 35 U.S.C. 154(b) by 23 days.

(21) Appl. No.: 11/162,254

(22) Filed: Sep. 2, 2005

(65) Prior Publication Data

US 2006/0042431 A1 Mar. 2, 2006

Related U.S. Application Data

(60) Provisional application No. 60/522,224, filed on Sep. 2, 2004.

(51) Int. Cl.
*B25B 27/00* (2006.01)
*A47G 27/04* (2006.01)

(52) U.S. Cl. ..... 81/488; 7/103

(58) Field of Classification Search ..... 81/488; 7/103, 105

See application file for complete search history.

(56) References Cited

U.S. PATENT DOCUMENTS 2,416,913 A * 3/1947 Del Debbio et al. ..... 30/152
2,635,337 A * 4/1953 Mercy ..... 30/353
3,685,064 A * 8/1972 Cuscovitch, Sr. ..... 7/103
3,790,976 A * 2/1974 Stencil ..... 7/103
4,308,628 A * 1/1982 Kunberger et al. ..... 7/145
4,565,004 A * 1/1986 Heinz ..... 30/314
4,872,231 A * 10/1989 Gustavsen ..... 7/103
5,251,352 A * 10/1993 Cullison ..... 7/105
5,647,080 A * 7/1997 Martin ..... 7/103
5,829,082 A * 11/1998 Moreira ..... 7/167
D424,390 S * 5/2000 Denton ..... D8/45
6,131,222 A * 10/2000 Anderson et al. ..... 7/105
D435,154 S * 12/2000 Garon ..... D32/42
D435,408 S * 12/2000 Panfili et al. ..... D8/16
D450,994 S * 11/2001 Abbott ..... D8/105
6,327,728 B1 * 12/2001 Hart ..... 7/105
D515,887 S * 2/2006 Denton ..... D8/16
D516,394 S * 3/2006 Chen ..... D8/16
D520,827 S * 5/2006 Denton ..... D8/45
2004/0163264 A1 * 8/2004 Simonz ..... 30/517

* cited by examiner

*Primary Examiner*—David B. Thomas
(74) *Attorney, Agent, or Firm*—Gary M. Hartman; Domenica N. S. Hartman; Hartman & Hartman, P.C.

(57) ABSTRACT

A carpet installation tool capable of being used to crease and tuck carpets in a wide variety of locations, including those difficult to access. The tool includes a handle that defines a longitudinal axis of the tool and a head disposed at one end of the handle. The handle has a longitudinal length sufficient to accommodate at least one hand of a user. The head has a neck portion adjacent the handle, a heel portion adjacent the neck portion, and a toe portion adjacent the heel portion. The neck portion extends at an acute angle to the longitudinal axis of the tool, and has a length sufficient to accommodate a hand of the user. The heel portion is adjacent the neck portion so that a heel edge defined thereby is offset from the longitudinal axis of the tool in a direction transverse to the longitudinal axis. The heel and toe portions define a distal edge that extends in a direction transverse to the longitudinal axis of the tool. The toe portion defines a point that is on an opposite side of the longitudinal axis of the tool relative to the heel edge.

20 Claims, 1 Drawing Sheet

CARPET INSTALLATION TOOL

This application claims the benefit of U.S. Provisional Application No. 60/522,224, filed Sep. 2, 2004.

BACKGROUND OF THE INVENTION

The present invention generally relates to tools suitable for use when installing floor coverings such as carpets. More particularly, this invention relates to a handheld multi-purpose carpet installation tool adapted to crease and tuck carpets.

Various tools have found use for installing carpets and other floor coverings. Examples include tools adapted to crease a carpet where the surface being covered (e.g., a floor or step tread) meets an adjoining vertical surface (such as a wall or step riser), tools adapted to tuck the edge of a carpet beneath a baseboard or other trim piece, and tools adapted to assist in the removal of a carpet. Such tools are often not designed or well suited for performing multiple tasks in an efficient manner, and may be of limited use in confined areas such as stairs and doorjambs because their size or shape.

Accordingly, there is a need for a handheld tool capable of being used to perform multiple functions when working with carpets, especially in confined areas.

BRIEF SUMMARY OF THE INVENTION

The present invention provides a carpet installation tool capable of being used to crease and tuck carpets in a wide variety of locations, including those difficult to access. The carpet installation tool is also capable of performing various other operations that may arise when working with a carpet.

The tool of this invention includes a handle that defines a longitudinal axis of the tool and a head disposed at an end portion of the handle. The handle has a longitudinal length sufficient to accommodate at least one hand of a user. The head has a neck portion adjacent the end portion of the handle, a heel portion adjacent the neck portion, and a toe portion adjacent the heel portion. The neck portion extends at an acute angle to the longitudinal axis of the tool, and has a length sufficient to accommodate a hand of the user. The heel portion is adjacent the neck portion so that a heel edge defined thereby is offset from the longitudinal axis of the tool in a direction transverse to the longitudinal axis. The heel and toe portions define a distal edge that extends in a direction transverse to the longitudinal axis of the tool. The toe portion defines a point that is on an opposite side of the longitudinal axis of the tool relative to the heel edge.

A significant advantage of this invention is that the carpet installation tool provides multiple edges and features that can be used to perform a variety of functions associated with the installation and removal of carpets, including creasing a carpet at the intersection of a surface being carpeted and an adjoining wall or surface, and tucking the edge of a carpet beneath a baseboard or other trim piece. The shape of the head relative to the handle is such that considerable leverage is available when using the tool, notably when installing or removing carpet in areas difficult to access and around features such as door jambs, transition pieces, etc.

Other objects and advantages of this invention will be better appreciated from the following detailed description.

DETAILED DESCRIPTION OF THE INVENTION

Figure 1:
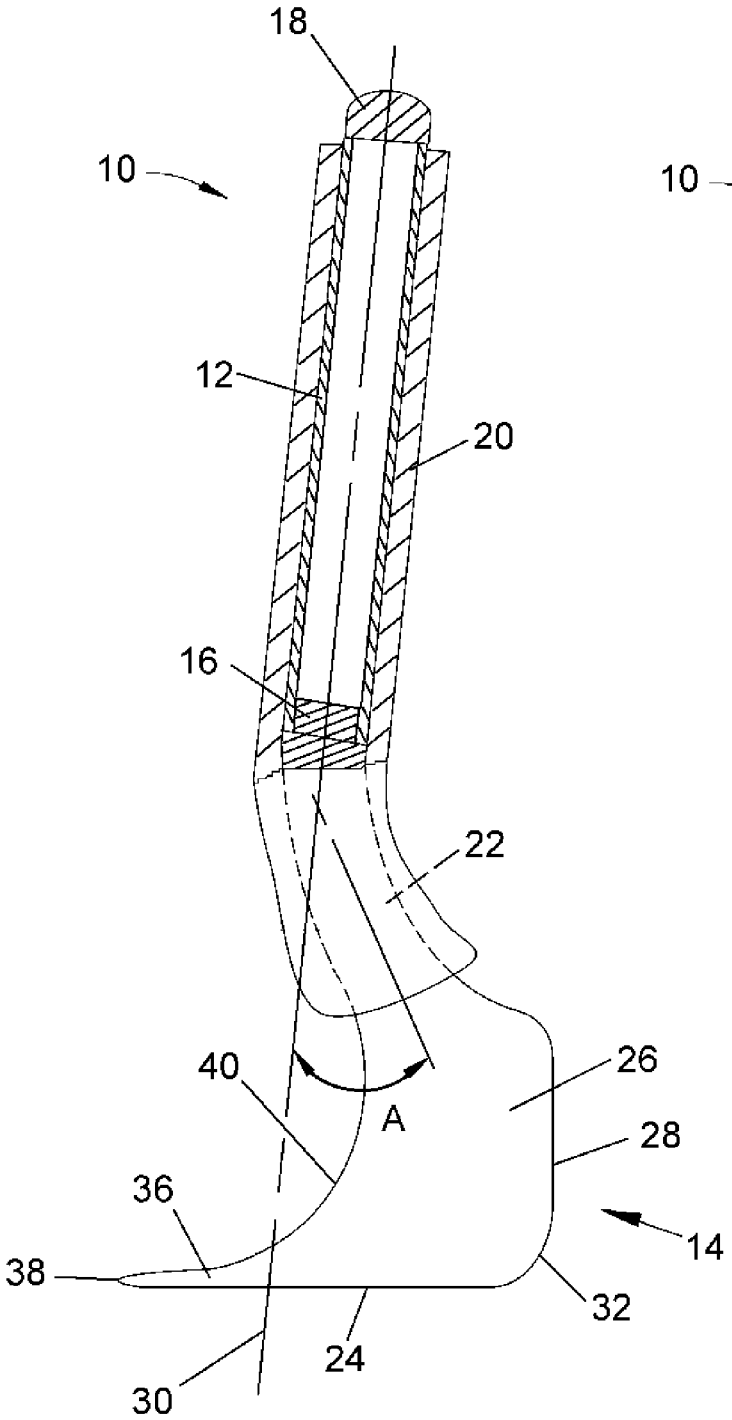
FIG. 1 is a side view in partial cross-section of a carpet installation tool in accordance with a preferred embodiment of the invention.
Figure 2:
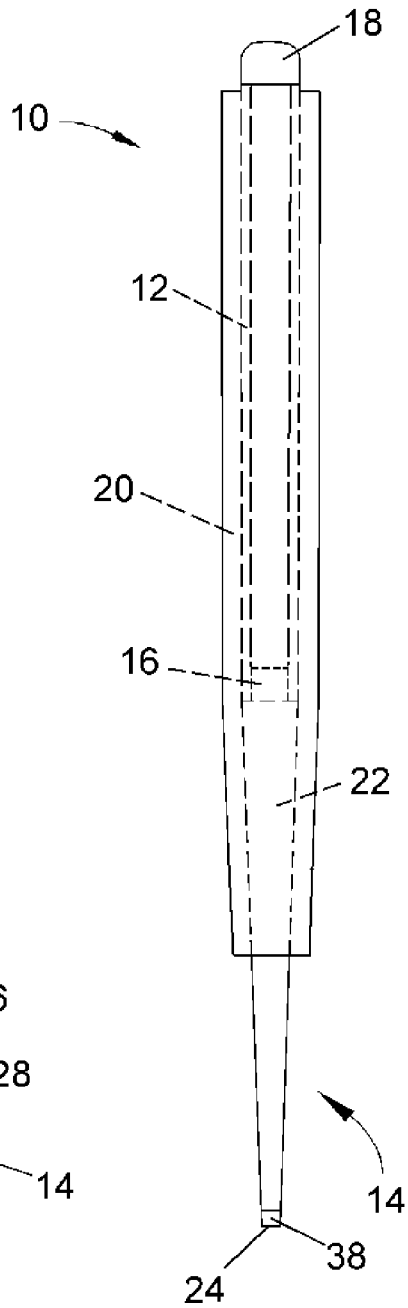
FIG. 2 is a frontal view of the carpet installation tool of FIG. 1.

FIGS. 1 and 2 are views of a preferred embodiment of a carpet installation tool 10 in accordance with the present invention. The tool 10 is shown as having a handle 12 and head 14. The handle 12 is shown as being in the form of a tube having an oval-shaped cross-section, though other configurations are possible. The handle 12 is generally straight and defines a longitudinal axis 30 of the tool 10, as seen in FIG. 1, while the head 14 is somewhat hook-shaped and tapered so as to decrease in thickness away from the handle 12, as seen in FIG. 2. The head 14 is shown as being formed with a stud 16 received within the interior of the handle 12 to assist in the attachment of the head 14 to the end of the handle 12, such as by welding, etc. Both the handle 12 and head 14 of the tool 10 are preferably made of steel, though the use of other materials is foreseeable. While the head 14 is depicted as being formed separately and attached to the handle 12, it is foreseeable and within the scope of this invention that the handle 12 and head 14 could be formed as a unitary body. A cap 18 is shown mounted to the end of the handle 12 opposite the head 12, and a covering 20 covers the entire handle 12 as well as a neck 22 of the head 12. To provide a comfortable but firm grip, the covering 20 is preferably formed of a vinyl material or another suitable material.

As will be evident from FIGS. 1 and 2 and the following discussion, the handle 12 and head 14 are configured to provide ample leverage when using the tool 10 to install and remove carpeting. While various dimensions of the tool 10 are capable of promoting this aspect of the invention, particularly preferred dimensions for the tool 10 include the length of the handle 12 being about seven inches (about 18 cm) along the longitudinal axis 30, with the head 14 extending about 5.5 inches (about 14 cm) along the longitudinal axis 30 and terminating in a distal edge 24. In use, both the handle 12 and the neck 22 of the head 14 are intended to be gripped. For this reason, the covering 20 is shown as extending about three inches (about 8 cm) or so down the length of the neck 22, providing the tool 10 with an approximately 10-inch (about 25 cm) gripping length.

As evident from FIG. 1, the neck 22 of the head 14 is disposed at an angle A to the longitudinal axis 30 of the tool 10. A suitable angle A is about 25 degrees, though greater and lesser angles are also foreseeable. Adjacent the neck 22 is what is referred to herein as a heel 26. The heel 26 generally extends in a direction approximately parallel to the longitudinal axis 30 of the tool 10, and defines a heel edge 28 that is also approximately parallel to the longitudinal axis 30. The heel edge 28 is interconnected with the distal edge 24 through an arcuate corner edge 32 whose radius is preferably about one inch (about 2.5 cm), though greater or lesser radii are foreseeable. Because of the angle of the neck 22, the heel 26 and its edge 28 are both laterally offset to one side of the longitudinal axis 30 of the tool 10. For example, the heel edge 28 may be offset about 2.5 to 3 inches (about 6 to 8 cm) from the axis 30. This offset enables the heel edge 28 to be engaged with a carpet (not shown) while the user's hands (on the handle 12 and neck 22) remain clear of the carpet.

The distal edge 24 is defined by the heel 26 and a toe portion 36 of the head 14 that extends in a direction transverse to the longitudinal axis 30 and terminates at a point 38. As evident from FIG. 1, the distal edge 24 is also oriented transverse to the longitudinal axis 30, and preferably nearly perpendicular to the axis 30. Because the head 14 is tapered, the distal edge 24 is thinner than the remainder of the head 14, with a suitable thickness for the distal edge 24 being about one-eighth inch (about 3 mm). A suitable length for the distal edge 24 is about 3.25 inches (about 8 cm). With this orientation, length, and thickness, the distal edge 24 is particularly well adapted for creasing a carpet while applying force and leverage through the handle 12. Because the toe portion 36 and its point 38 are also oriented transverse to the axis 30 of the tool 10, they are suitably oriented to enable a user gripping the handle 12 and neck 22 to apply a localized force, such as when tucking a carpet beneath a baseboard, transition strip, doorjamb, etc. The toe portion 36 adjacent the point 38 preferably has a width of about one-eighth inch (about 3 mm) to enable the point 38 to be inserted into small spaces. Finally, the heel 26 and toe portion 36 together define an arcuate interior edge 40 that merges with the neck 22. Based on the aforementioned dimensions, a suitable radius for the interior edge 40 is about four inches (about 10 cm).

The above structural features of the tool 10 have a variety of uses, some of which are summarized below. The primary purpose of the handle 12 is to apply a force with the head 14 when using the tool 10 to crease a carpet prior to trimming or tuck a carpet beneath a baseboard, transition strip, doorjamb, etc., after the carpet has been trimmed. According to a preferred aspect of the invention, a creasing operation can be performed by pushing the corner edge 32 of the head 14 into the junction between the floor and wall, tread and riser, etc., and then pivoting the handle 12 while the head 14 remains engaged with the carpet so that the force applied by the head 14 is transferred from the corner edge 32 to the toe portion 36. The curvature of the head 14 provides the user with better access to relatively confined spaces, while the orientation of the neck 22 relative to the handle 12 provides greater leverage, especially when the tool is used in confined spaces. The length and orientation of the handle 12 also provides leverage to enable use of the toe portion 36 to pry up transition strips, etc., when removing a carpet. The heel 26 and its relatively blunt edge 28 can also be used during installation of a carpet, especially in confined spaces such as a closet, by striking the edge of the carpet to secure the carpet.

While the invention has been described in terms of preferred embodiments, it is apparent that other forms could be adopted by one skilled in the art. For example, a variety of materials could be used to form the tool 10, and the orientations, lengths, and angles between the various portions of the tool 10 could differ from that shown and described. Furthermore, while described in reference to installing and removing carpets, it is foreseeable that the tool of this invention could be adapted to install other types of floor coverings. Therefore, the scope of the invention is to be limited only by the following claims.

What is claimed is:

1. A carpet installation tool comprising:

a handle defining a longitudinal axis of the tool, the handle having an end portion and a longitudinal length sufficient to accommodate at least a first hand of a user; and a head disposed at the end portion of the handle, the head having a neck portion extending from the end portion of the handle, a heel portion directly adjacent the neck portion, and a toe portion adjacent the heel portion, the neck portion being disposed at an acute angle to the longitudinal axis of the tool and having a length sufficient to accommodate at least a second hand of a user, the heel portion defining a heel edge offset from the longitudinal axis of the tool in a direction transverse to the longitudinal axis, the heel and toe portions defining a distal edge of the head, the distal edge extending in a direction transverse to the longitudinal axis of the tool, the toe portion defining a point, the heel edge and the point of the toe portion being on opposite sides of the longitudinal axis of the tool.

2. The carpet installation tool according to claim 1, wherein the heel edge is substantially parallel to the longitudinal axis of the tool.

3. The carpet installation tool according to claim 1, wherein the distal edge is substantially straight and substantially perpendicular to the longitudinal axis of the tool.

4. The carpet installation tool according to claim 1, wherein the distal edge has a length of about three inches.

5. The carpet installation tool according to claim 1, wherein the distal edge has a thickness of about one-eighth inch.

6. The carpet installation tool according to claim 1, further comprising an arcuate edge connecting the heel edge and the distal edge.

7. The carpet installation tool according to claim 6, wherein the arcuate edge defines a radius of about one inch.

8. The carpet installation tool according to claim 1, wherein the head is tapered so as to be thicker adjacent the handle than at the distal edge.

9. The carpet installation tool according to claim 1, wherein the head has a thickness of about one-eighth inch at the distal edge.

10. The carpet installation tool according to claim 1, wherein the toe portion has a width of about one-eighth inch in a direction substantially parallel to the longitudinal axis of the tool.

11. A carpet installation tool comprising:

a handle defining a longitudinal axis of the tool, the handle having an end portion and a longitudinal length sufficient to accommodate at least a first hand of a user; and a head disposed at the end portion of the handle, a heel portion adjacent the neck portion, and a toe portion adjacent the heel portion, the neck portion having a length sufficient to accomodate at least a second hand of a user, the neck portion extending in a direction that defines an acute angle to the longitudinal axis of the tool in a direction transverse to the longitudinal axis, the heel and toe portions defining a distal edge of the head, the distal edge extending in a direction transverse to the longitudinal axis of the tool, the toe portion defining a point, the heel edge and the point of the toe portion being on opposite sides of the longitudinal axis of the tool;

wherein the heel and toe portions define a continuous arcuate interior edge oppositely disposed from the heel and distal edges.

12. The carpet installation tool according to claim 11, wherein the interior edge defines a radius of about four inches.

13. The carpet installation tool according to claim 1, wherein the acute angle between the neck portion and the longitudinal axis of the tool is about 25 degrees.

14. The carpet installation tool according to claim 1, wherein the head and handle are discrete components attached to each other.

15. The carpet installation tool according to claim 1, wherein the handle has an oval-shaped cross-section.

16. The carpet installation tool according to claim 1, further comprising a cover that surrounds and covers the handle and the neck portion of the head, the cover having an outer surface that promotes gripping of the handle and the neck portion with the fist and second hands, respectively, of the user.

17. The carpet installation tool according to claim 1, wherein the point of the toe portion is closer to the longitudinal axis of the tool than the heel edge.

18. The carpet installation tool according to claim 1, wherein the head is heavier than the handle.

19. The carpet installation tool according to claim 1, wherein the longitudinal length of the handle is greater than a length of the head measured from the handle to the distal edge along the longitudinal axis of the tool.

20. A carpet installation tool comprising:

a handle defining a longitudinal axis of the tool, the handle having an end portion and a longitudinal length sufficient to accommodate at least a first hand of a user; and a head attached to the end portion of the handle, the head having a neck portion adjacent the end portion of the handle, a heel portion adjacent the neck portion such that the neck portion is between the heel portion of the head and the end portion of the handle, and a toe portion adjacent the heel portion such that the heel portion is between the neck and toe portions of the head, the neck portion having a length sufficient to accommodate at least a second hand of a user, the neck portion extending in a direction that defines an acute angle to the longitudinal axis of the tool, the heel portion and a heel edge defined thereby being offset from the longitudinal axis of the tool in a direction transverse to the longitudinal axis of the tool, the heel and toe portions defining a distal edge of the head, the distal edge extending in a direction approximately perpendicular to the longitudinal axis of the tool and being connected to the heel edge by an arcuate outer edge, the toe portion defining a point, the heel edge and the point of the toe portion being on opposite sides of the longitudinal axis of the tool, the heel and toe portions defining a continuous arcuate interior edge oppositely disposed from the heel, arcuate outer, and distal edges.

* * * * *